United States Patent [19]

Tattersall

[11] 4,350,109

[45] Sep. 21, 1982

[54] WINDING ARRANGEMENTS

[75] Inventor: John C. Tattersall, Guildford, England

[73] Assignee: Olympic Power Winches Limited, England

[21] Appl. No.: 179,295

[22] PCT Filed: Apr. 10, 1979

[86] PCT No.: PCT/GB79/00058

§ 371 Date: Dec. 14, 1979

§ 102(e) Date: Dec. 6, 1979

[87] PCT Pub. No.: WO79/00932

PCT Pub. Date: Nov. 15, 1979

[30] Foreign Application Priority Data

| | | | |
|---|---|---|---|
| Apr. 14, 1978 | [GB] | United Kingdom | 14744/78 |
| Jul. 25, 1978 | [GB] | United Kingdom | 30992/78 |
| Oct. 12, 1978 | [GB] | United Kingdom | 40286/78 |

[51] Int. Cl.[3] ..... B63H 9/10

[52] U.S. Cl. ..... 114/105; 74/30; 74/812; 91/218; 92/136; 254/276; 254/299

[58] Field of Search ..... 114/102, 104, 105; 254/299, 309, 315, 276, 346, 355; 74/30, 812; 92/136; 91/459, 218, 277

[56] References Cited

U.S. PATENT DOCUMENTS

| | | | |
|---|---|---|---|
| 549,118 | 11/1895 | Faulkner | 74/30 X |
| 615,194 | 11/1898 | Parkinson | 92/136 X |
| 2,845,902 | 8/1958 | Anderson | 91/459 X |
| 3,411,751 | 11/1968 | Pooley, Jr. | 114/102 |
| 4,013,031 | 3/1977 | Viviano | 114/102 X |

FOREIGN PATENT DOCUMENTS

| | | | |
|---|---|---|---|
| 2505053 | 8/1976 | Fed. Rep. of Germany | 114/104 |

*Primary Examiner*—Sherman D. Basinger
*Attorney, Agent, or Firm*—Keil & Witherspoon

[57] ABSTRACT

A winding arrangement suitable for sheeting in a sail of a yacht comprising a winch drum and a piston cylinder assembly having a double-acting piston which is reciprocable within a cylinder. A rack member, coupled to the piston, produces unidirectional rotation of the winch drum through a particular clutch and gear system. A manually operated pump is arranged to supply fluid under pressure to the piston-cylinder assembly through supply pipes and a valve which directs the fluid supplied by the pump to opposite ends of the cylinder alternately, thereby to reciprocate the piston and rotate the winch drum.

8 Claims, 9 Drawing Figures

WINDING ARRANGEMENTS

TECHNICAL FIELD OF THE INVENTION

This invention relates to a winding arrangement, and has an important application to winding arrangements such as can be used on yachts or other sailing vessels to shorten foresail sheets.

BACKGROUND ART

Sailing techniques often require the rapid shortening of foresail sheets and, in this operation, as a foresail sheet is shortened, the resistance to further shortening is increased to such an extent that even very strong people are not always able to sheet the foresail in as far as they would like, even with the most up-to-date hand-operated, geared sheet winches.

One way of alleviating this problem is to provide each sheet winch with an electric motor which can be driven from an electric storage battery carried by the yacht. However, this involves the use of relatively expensive and heavy storage batteries, particularly if the electric motors are designed to absorb the large amounts of power necessary to rapidly shorten the foresail sheets subject to relatively high tension. In addition, the drain on the electric storage batteries presents a serious safety hazard in that electric storage batteries in yachts are normally provided for the operation of electronic apparatus such as radio telephone and navigation equipment which are vital in an emergency. It is for this reason that the yachtsmen are reluctant to run the risk of overloading their electric storage batteries.

DISCLOSURE OF THE INVENTION

An object of this invention is to provide a hand-operated winch with which it is possible to avoid the physical drudgery involved in the use of conventional hand-operated sheet winches without having to rely on the expenditure of energy drawn from an electric storage battery.

The present invention comprises a winding arrangement suitable for sheeting in a sail of a sailing yacht, including a winch drum and a piston cylinder assembly having a double acting piston which is reciprocable within a cylinder. A double toothed rack member is coupled to the winch drum through unidirectional clutches and gear drives which mesh with opposing toothed surfaces on the rack member and are arranged to produce unidirectional rotation of the winch drum. A manually operated pump is arranged to supply fluid under pressure to the piston-cylinder assembly through supply pipes and a valve means which directs the fluid supplied by the pump to opposite ends of the cylinder alternately, thereby to reciprocate the piston and rotate the winch drum. This valve means is preferably a flow reversing valve operated by the rack member being in its furthest position in either direction. The winding arrangement may include more than one winch drum connected to each piston cylinder assembly. Thus, a winch drum may be located on either end of the piston cylinder assembly, both driven by double toothed rack members on each movement of the piston.

In the typical embodiment separate winding arrangements will be provided for the port and starboard sides of a yacht. Each piston cylinder assembly will be driven by a manually operable hydraulic pump. As a practical matter, the hydraulic pump will be located on the opposite side of the yacht from its associated winding arrangement. A hydraulic fluid sump may also be provided which can serve both port and starboard hydraulic pumps.

A pressurized hydraulic fluid vessel may be located between the hydraulic pump and the piston cylinder assembly. A control valve, operated manually or by an electrical switch, may be located between the pressurized fluid vessel and the piston cylinder assembly to permit the operation of the winding arrangement remotely and independently of the hydraulic pump. In this case a single pump may be used which, located centrally, can be used with both port and starboard assemblies.

Embodiments of the invention will now be described, by way of example, with reference to the accompanying drawings.

BEST MODES FOR CARRYING OUT THE INVENTION

Figure 1:
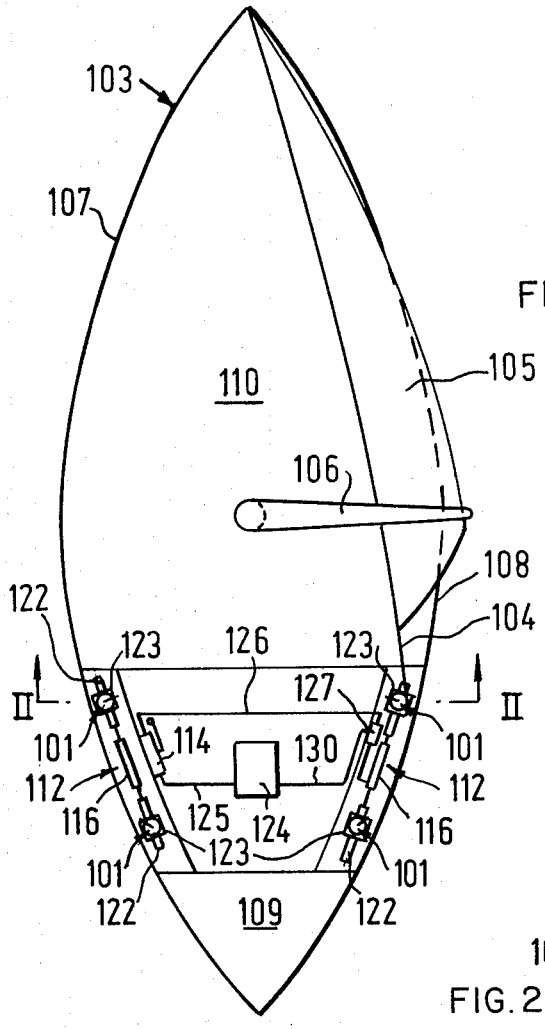
FIG. 1 is a plan view of a yacht equipped with four modified winding arrangements in accordance with the invention.
Figure 2:
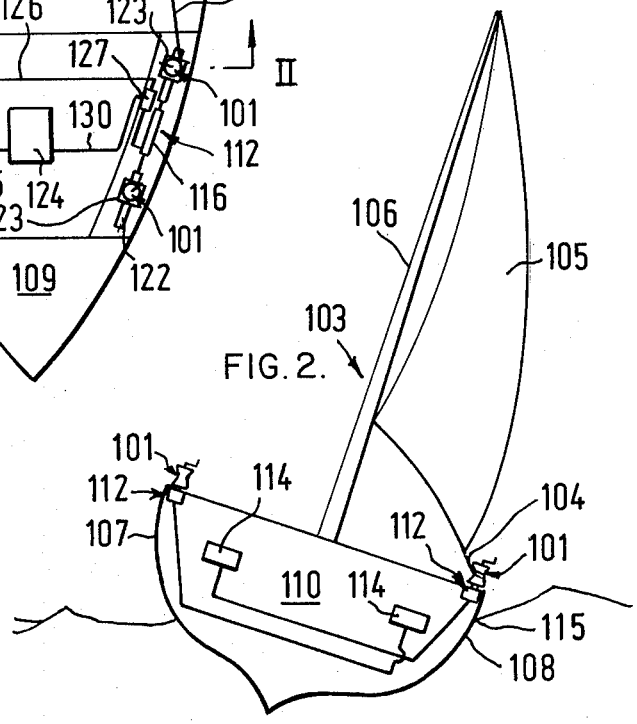
FIG. 2 is a sectional end elevation of the yacht shown in FIG. 1 taken on the line II—II.

Referring in the first instance to FIGS. 1 and 2 the yacht 103 is provided with four winding arrangements 101 for sheeting in a sheet or line 104 connected to a foresail 105 supported on a mast 106. Two of the winding arrangements are mounted on the port side 107 and two on the starboard side 108 of the stern end 109 of the hull 110. Each winding arrangement 101 comprises a winch drum 102 driven by a hydraulic motor 112 and control means 114 for operating the hydraulic motors 112. As shown in FIG. 2, the control means 114 for each motor 112 are disposed remote from the side 107 or 108 of the stern end 109 of the hull 110 on which the motor 112 is mounted.

Thus, when the yacht 103 is heeling over the starboard side 108, as shown in FIG. 2, each winding arrangement 101 on the starboard side 108 of the yacht 103 can be operated to sheet-in the foresail 105 by operation of the control means on the port hand side 107, without any undue difficulty arising from the fact that the winding arrangements 101 on the starboard side 108 are dipping almost to the water line 115.

As shown more clearly in FIG. 1, the control means 114 for the hydraulic motor 112 on the starboard side 108 of the hull 110 is a manually-operable hydraulic pump 114. A similar pump is provided for controlling operation of the hydraulic motor 112 on the port side 107 of the hull 110, but for the sake of clarity of illustration, this additional pump has been omitted from FIG. 1.

Figures 3, 4:
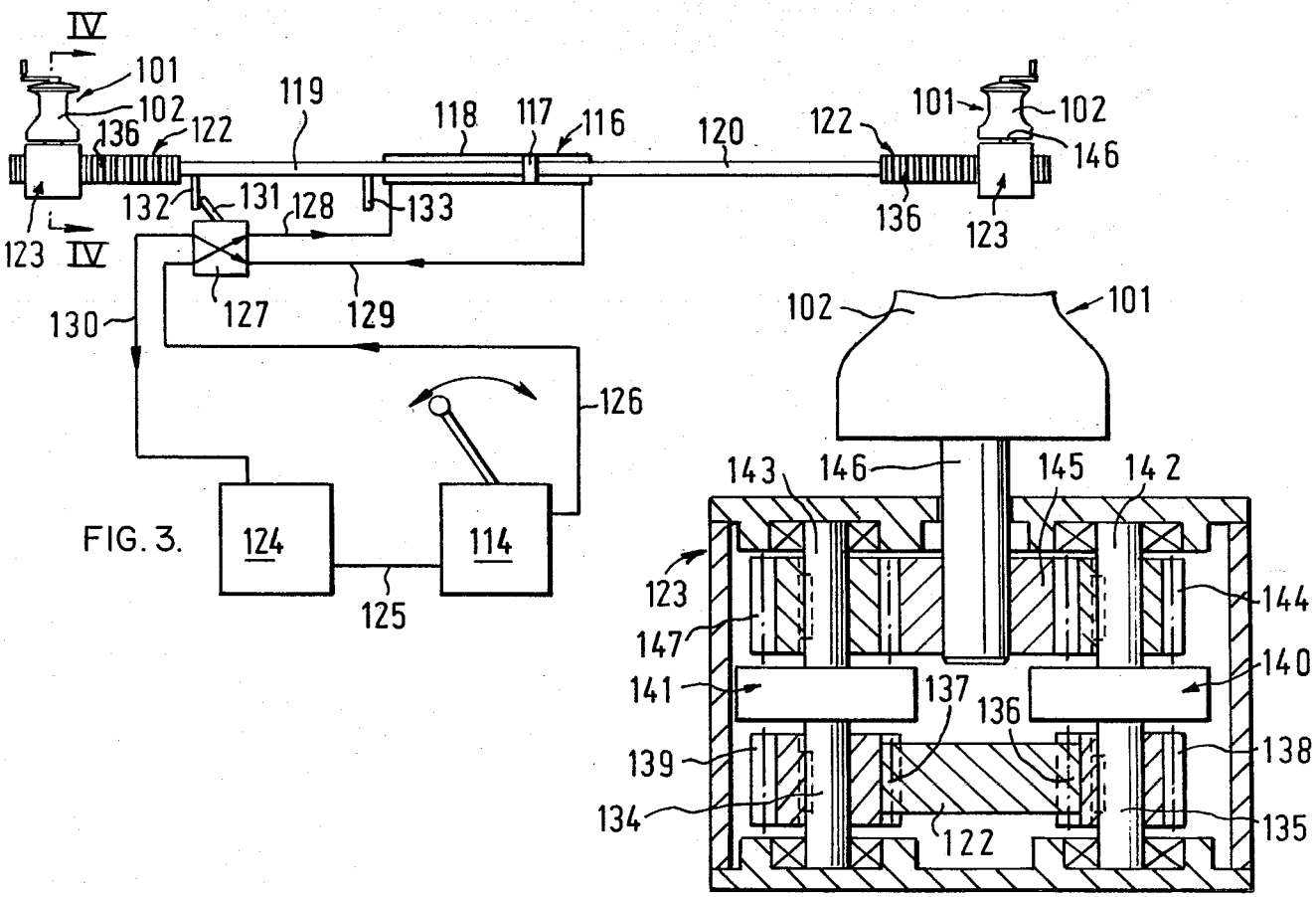
FIG. 3 is a schematic diagram of the hydraulic circuit of two of the winding arrangements shown in FIGS. 1 and 2.
FIG. 4 is a sectional end elevation of a gear box forming part of the apparatus shown in FIG. 3 taken on the line IV and IV.

From reference to FIG. 3, which is a schematic representation of the two winding arrangements 101 on the starboard side 108 of the yacht 103 it is clear that the hydraulic motor 112 comprises a piston-cylinder assembly 116 having a double acting piston 117 which is reciprocable within a hydraulic cylinder 118. Connecting rods 119 and 120 extend through the opposite ends of the cylinder 118 from opposite sides of the piston 117. At their outer ends, the connecting rods 119 and 120 are respectively connected to two rack members 122 which are respectively reciprocable, on operation of the piston cylinder assembly 116, through two gear boxes 123 which are drivingly connected to the two winding arrangements respectively. As hereinafter described, with reference to FIG. 4, the gear boxes 123 are operable to drive the winch drums 102 continuously in one direction as a result of reciprocating movement of the rack members 122.

On operation of the manually-operable hydraulic pump 114, hydraulic fluid is drawn from a sump 124 through a pipe line 125, pressurised, and then passed through a supply line 126 and a changeover valve 127 to a first cylinder line 128 connected to one end of the cylinder 118 so as to drive the piston 117 towards the other end of the cylinder 118. Hydraulic fluid from the other end of the cylinder 118 passes by way of a second cylinder line 129, the changeover valve 127 and a discharge line 130 which returns the discharged hydraulic fluid to the sump 124.

In order to effect return movement of the piston 117, the changeover valve 127 is operated so as to reverse the connections between the supply and discharge lines 126 and 130 with the first and second cylinder lines 128 and 129. This operation is achieved by displacement of a bi-stable trigger 131 on the changeover valve 127 by strikers 132 and 133 carried by opposite ends of the adjacent connecting rod 119. Thus, as shown in FIG. 3, operation of the pump 114 causes the piston 117 to move towards the left until striker 132 displaces trigger 131 from one of its stable positions to its other stable position. This results in reversal of flow of hydraulic fluid into and out of the cylinder 118 and so the piston 117 reverses its direction of movement and moves towards the left. At the completion of this leftward movement, the other striker 133 returns the trigger 131 to its first stable position, thus causing a reversal in the flow of hydraulic fluid into and out of the cylinder 118 and a consequent reversal in the direction of movement of the piston 117.

In practice, the winding arrangements 101 on the port side 107 of the hull 110 are controlled in a completely analagous way by apparatus which, in general, is the same as the apparatus hereinbefore described. However, it is only necessary to provide one sump 124.

As shown in FIG. 4, each rack member 122 is arranged for reciprocating movement between two clutch shafts 134 and 135 so that two toothed racks 136 and 137 formed, respectively, on opposite edges of the rack member 122 respectively mesh with two pinions 138 and 139 which are keyed to the clutch shafts 134 and 135 respectively, so as to cause the two clutch shafts 134 and 135 to rotate in opposite directions. Two unidirectional clutches 140 and 141 respectively connect the clutch shafts 134 and 135 to two coaxially aligned drive shafts 142 and 143 and are constructed so that when each clutch shaft 134 and 135 is rotated in one direction, say clockwise, when viewed from above, this clockwise movement is transmitted to the coaxially aligned shaft 142 or 143 whereas, when each clutch shaft 134 and 135 is rotated in the other direction, i.e. anticlockwise, when viewed from above, the coaxially aligned drive shaft 142 or 143 is able to rotate freely in the opposite or clockwise direction.

Thus, if the rack member 122 is moved in a direction which causes clockwise rotation of pinion 138 and clutch shaft 134, as viewed from above, this motion is transmitted to drive shaft 142 through unidirectional clutch 140. A driving pinion 144 keyed to drive shaft 142 meshes with a driven pinion 145 which is keyed to a shaft 146 carrying a winch drum 102 so as to drive the winch drum 102 in an anticlockwise direction. During this anticlockwise movement of the winch drum 102, the pinion 139 and clutch shaft 134 are driven in an anticlockwise direction by the toothed rack 137, but the drive shaft 143 is driven in a clockwise direction by means of a further driving pinion 147 which is keyed to the drive shaft 143 and measures with the driven pinion 145. In this case, the oppositely directed rotations of the coaxially aligned shafts 143 and 134 are accommodated by the unidirectional clutch 141.

When the rack member 122 is moved in the opposite direction, so as to cause the pinion 139 and the clutch shaft 134 to rotate in a clockwise direction, as viewed from above, this movement is transmitted to the coaxially aligned drive shaft 143 and so the winch drum 102 continues to move in an anticlockwise direction. In this case, the clockwise movement of the drive shaft 142 and the anticlockwise rotation of the coaxially aligned shaft 135 are accommodated by the unidirectional clutch 140.

Figure 5:
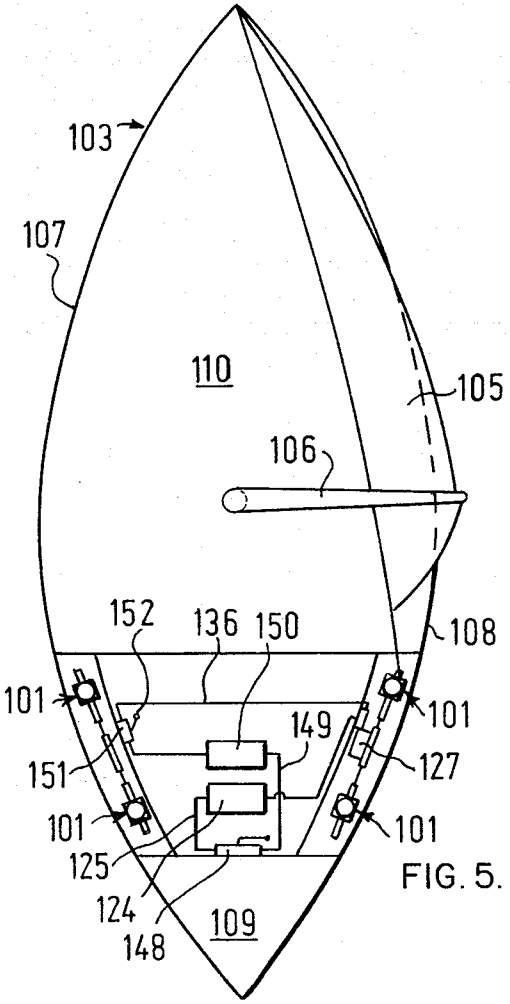
FIG. 5 is a plan view similar to FIG. 1 but showing a modified arrangement.

In the yacht 103 illustrated in FIG. 5, the apparatus illustrated in FIG. 1 is modified by the replacement of the two pumps 114 with a single, manually-operable, centrally disposed hydraulic pump 148, and by the insertion of a transfer line 149 and a pressurised hydraulic fluid vessel 150 between the pump 148 and the supply line 136 and by the insertion of a control valve 151 in a part of the supply line 136 which is remote from the starboard side 108 of the stern end 109 of the hull 110 where the winding arrangements 101 controlled by this valve are mounted. When opened, control valve 151 directs pressurized fluid to the changeover valve 127 to reciprocate the piston 117. When 151 is closed the piston 117 will remain stationary. This control valve 151 is provided with an actuating handle 152 which, being on the control valve 151, serves as control means which are disposed remote from the starboard 108 of the stern end 109 of the hull 110, on which the winding arrangements 101 controlled by the valve 151 are mounted. However, in alternative forms of construction, the control valve 151 may be placed in other parts of the supply line 136, but is remotely actuated by control means, such as an electrical switch, disposed in a position such as the position occupied by the valve 151 in the embodiment illustrated in FIG. 5.

Although not shown, for the sake of clarity of illustration, the winding arrangements 101 mounted on the port side 107 of the stern end 109 of the hull 110 are controlled in a completely analogous way by apparatus which, in general, is the same as the apparatus hereinbefore described with reference to FIG. 5. However, in this case, the sump 124, the pressurised hydraulic fluid vessel 150 and a single, centrally mounted manually-operable hydraulic pump 148 are common to the apparatus provided for controlling the winding arrangements 101 on both sides 107 and 108 of the hull 110.

Although not specifically described with reference to the drawings, it is clear that the piston-cylinder assemblies 21 can be provided for pneumatic operation instead of for hydraulic operation. In this case, the further modification of the apparatus hereinbefore described merely involves the omission of the sumps 124, the inlet lines 125 and the discharge lines 130.

As the winding arrangements 101 are self-tailing, loosening of the foresail sheet 104 can be effected simply by flicking the sheet 104 from the winch drum 102. Where the winding arrangements 101 are not constructed as self-tailing, it is necessary to loop the sheet around the winch drum 102 and to maintain purchase by hand tension. In this case, loosening of the sheet is effected merely by releasing this hand tension.

Figure 7:
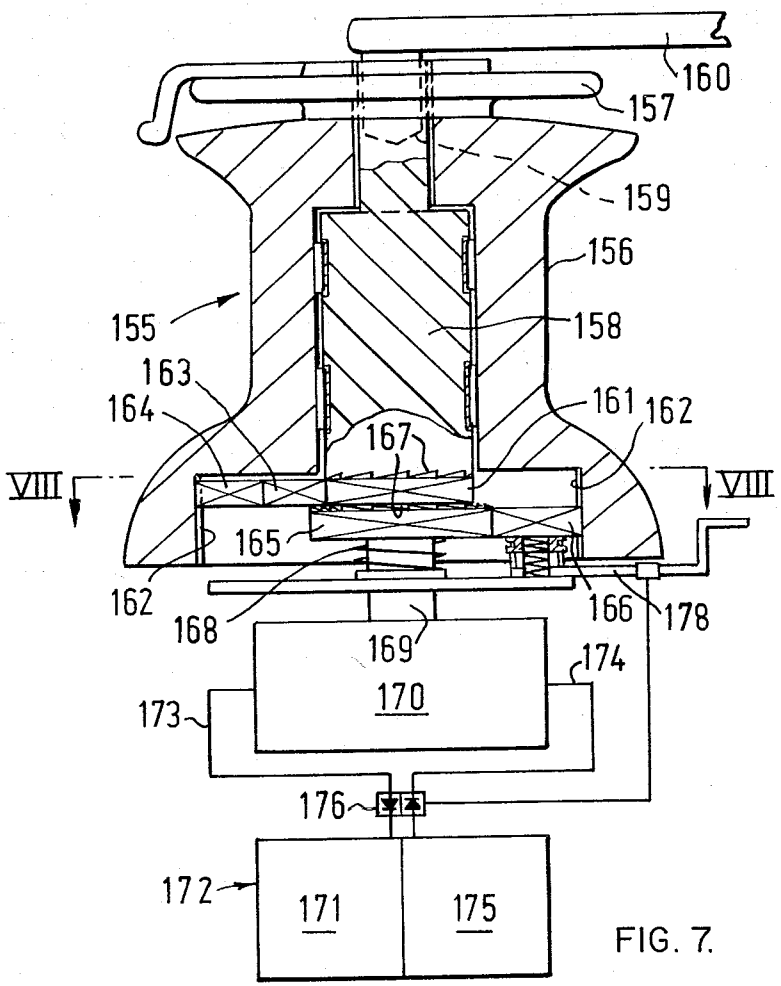
FIG. 7 is a schematic side elevation shown in section, of a winch drum shown in FIG. 6.
Figure 8:
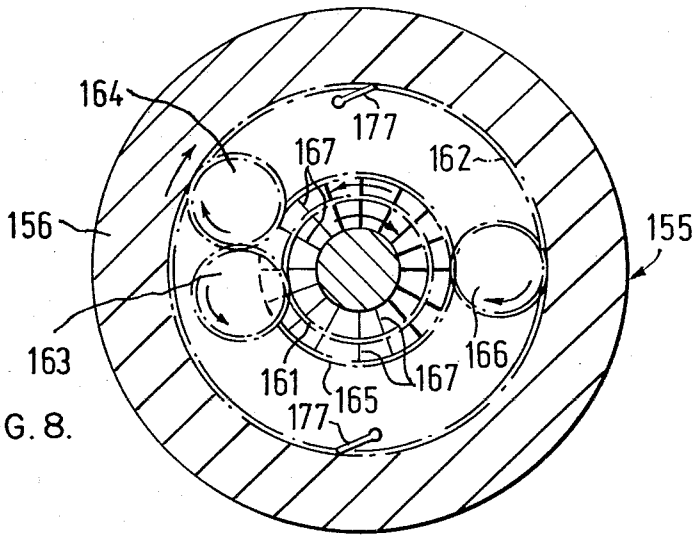
FIG. 8 is a sectional plan view of the winch drum shown in FIG. 6.

Referring now to FIGS. 7 to 8, a winding arrangement 155, embodying the present invention, includes a winch drum 156 provided with a self-tailing device 157. A hand-driven barrel 158 extends internally of the drum 156, along the central axis of the drum 156, and is formed with a socket 159 for receiving a removable handle 160 (only partly shown). A first sun gear 161 is connected to a ring gear 162 formed internally of the winch drum 156 by means of first idler gears 163 and 164 and a second sun gear 165 is connected to the ring gear 162 by means of a second idler gear 166.

As shown in FIG. 7, the first sun gear 161 is connected to the barrel 158 by means of a first unidirectional clutch so that, when the handle 160 is rotated in a clockwise direction, as viewed from above, this motion is transmitted to the winch drum 156, which also rotates in a clockwise direction, but at a lower speed. However, the handle 160 can be turned in the opposite direction without moving the first sun gear 161. Similarly, the second gear 165 is connected to the first sun gear 161 by a second unidirectional clutch so that when rotated in a clockwise direction; when viewed from above, this motion is also transmitted to the winch drum 156 and, when the second sun gear 161 is rotated in the opposite direction, there is no transmission of this movement. Although conventional unidirectional clutches would serve for connecting the barrel 158 and the first and second sun gears 161 and 165, it is preferred that these connections are made by radially extending serrations 167 formed on the engaging parts. In this case, a helical compression spring 168 is provided so as to press the first and second sun gears 161 and 165 axially towards the barrel 158.

On rotation of the winch drum 156, a second idler gear 166 drives second sun gear 165 in an anticlockwise direction as viewed from above. A shaft 169, connected to the second sun gear 165, therefore turns a hydraulic pump/motor 170 in an anticlockwise direction so as to draw hydraulic fluid from a sump 171 of an accumulator 172 through a hydraulic fluid line 173 and pressurised hydraulic fluid is delivered through another hydraulic fluid line 174 to a pressure vessel 175 in the accumulator 172. A control valve 176 in the lines 173 and 174 prevents flow of hydraulic fluid in the opposite direction.

When the loading on the handle 160 becomes uncomfortably high, the handle 160 can be released and the winch drum 156 is held by means of ratchet pawls 177 engaging the ring gear, as shown in FIG. 13. Control means 178 can then be operated so as to withdraw second idler gear 166 from meshing engagement with the second sun gear 165 so as to disconnect the pump/motor 170 from the handle 160. At this stage, the handle 160 may be turned further, as a result of the reduction in loading on the handle. However, regardless of whether the handle 160 is used to continue the winding of the sheet attached to the winch drum 156 or not, the control means 178 can be further operated to reverse the control valve 176, thus permitting pressurised hydraulic fluid to flow from the pressure vessel 175 to the sump 171 through the pump/motor 170, in the opposite direction, thus turning the shaft 169 in a clockwise direction, as viewed from above. This motion is therefore transmitted through the unidirectional connection between the first and second sun gears 161 and 165 and through the first idler gears 163 and 164 so as to continue the rotation of the winch drum 156 in its original direction. In order to terminate this final tightening of the sheet attached to the winch drum 156, it is merely necessary to reverse the control valve 176 by operating the control means 178.

In the assembly shown in FIG. 7, the hydraulic pump/motor 170 is a reversible gear pump and the gear ratio between the ring gear 162 and the second sun gear 165 is chosen, together with the gear ratio between the first sun gear 161 and the ring gear 162 so that the handle 160 is able to provide sufficient torque to suit the characteristics of the pump/motor.

Figure 6:
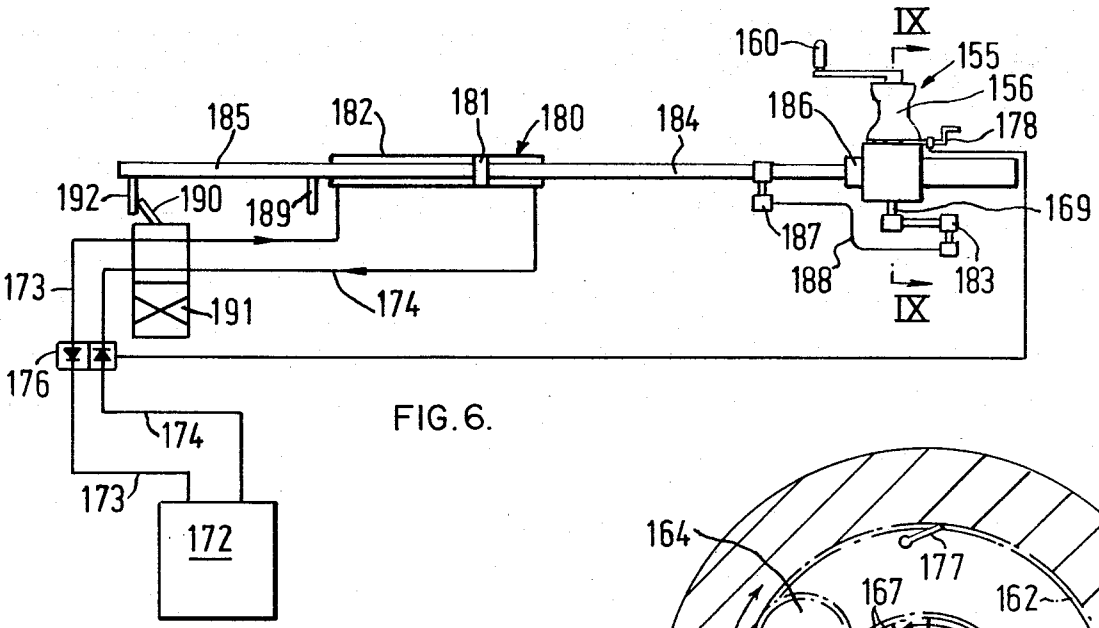
FIG. 6 is a schematic side elevation of another winding arrangement embodying the invention.
Figure 9:
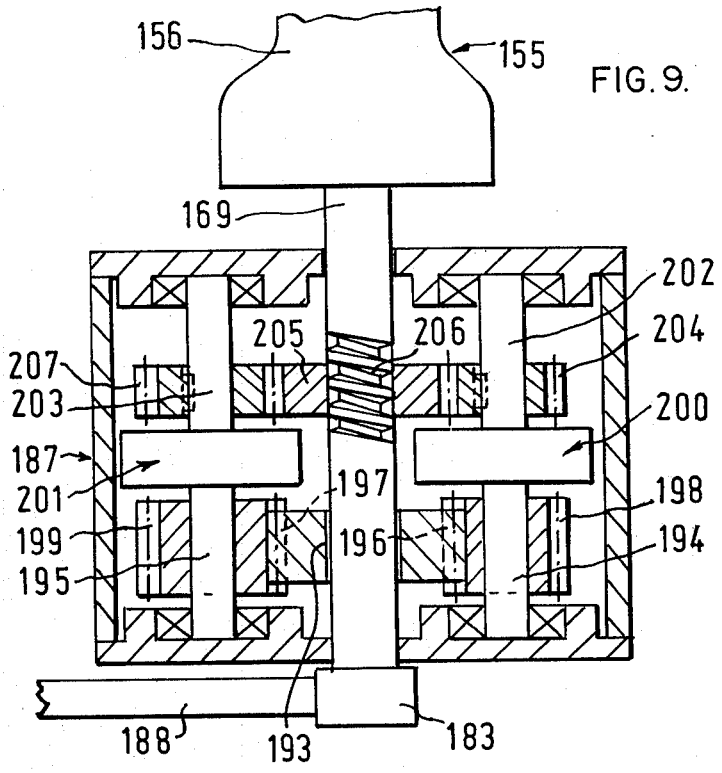
FIG. 9 is a sectional end elevation of a gear box forming part of the assembly shown in FIG. 6, taken on the line IX—IX in FIG. 6.

In the winding arrangement schematically shown in FIG. 6, the winch drum 156 and its internal gearing are constructed in the same manner as in the winding assembly 155 illustrated in FIGS. 7 and 8. In this case, the hydraulic pump/motor comprises a piston-cylinder assembly 180 having a double acting piston 181 which is reciprocable within a hydraulic cylinder 182 by means of a crank mechanism 183 connected to the shaft 169 extending from the second sun gear 165 of the winding arrangement. Piston rods 184 and 185 extend through opposite ends of the cylinder 182 from opposite sides of the piston 181. One of the connecting rods 184 is connected to a rack member 186 which is reciprocable, on operation of the piston-cylinder assembly 180, through a gear box 187 which, as hereinafter described, with reference to FIG. 9, is unidirectionally connected to the shaft 169 for driving the winch drum 156 in a clockwise direction as viewed from above.

The hydraulic pump/motor draws hydraulic fluid from a sump 171 of an accumulator 172 through a hydraulic fluid line 173 and pressurized hydraulic fluid is delivered through another hydraulic fluid line 174 to a pressure vessel 175 in the accumulator 172. A control valve 176 in the lines 173 and 174 prevents flow of hydraulic fluid in the opposite direction.

As shown in FIG. 6, when the handle 160 is being turned so as to rotate the winch drum 156 in a clockwise direction, as viewed from above a connecting rod 188 of the crank mechanism 183 pulls the piston 181 towards the right, thus charging the accumulatore 172 with pressurised hydraulic fluid while, at the same time, drawing low pressure hydraulic fluid from the accumulator 172 into the left hand end of the hydraulic cylinder 182.

The hydraulic fluid lines 173 and 174 connecting the cylinder 182 to the accumulator 172 pass through a control valve 176 connected to the control means 178 and through a reversing valve 188. Thus, on completion of the movement of the piston 181 towards the right, a striker 189 carried by the piston rod 185 displaces a bi-stable trigger 190 on the reversing valve 191, thus reversing the connections of the high pressure and low pressure lines 173 and 174 to the cylinder 182. As a result, further movement of the piston 181 towards the left, by means of the crank mechanism 183 causes further charging of the accumulator 172. When the piston 181 completes its leftward motion, a striker 192 carried by the piston rod 185 returns the bi-stable trigger 190 to its initial position so that charging of the accumulator 172 continues when the piston 181 is again moved towards the right.

When it is desired to utilise the stored energy within the accumulator 172 to rotate the winch drum 156, the control means 178 are first operated so as to disconnect the forward drive between the handle 160 and the crank mechanism 183 by disengaging the second idler gear 166 from the first sun gear 165. The control means 178 are then operated so as to reverse the control valve 176 so as to allow hydraulic fluid to circulate in the opposite direction.

The piston 181 is therefore reciprocated in an analogous manner to that which is described above. However, in this case, the piston 181 reciprocates the rack member 186.

In the gear box 187 shown in FIG. 9, the shaft 169 from the second sun gear 165 passes through a slot 193 formed in the rack member so as to allow the rack member 186 to reciprocate between two clutch shafts 194 and 195 so that two toothed racks 196 and 197 formed, respectively, on opposite edges of the rack member 186 respectively mesh with two pinions 198 and 199 which are keyed to the clutch shafts 194 and 195, respectively, so as to cause the two clutch shafts 194 and 195 to rotate in opposite directions. Two unidirectional clutches 200 and 201 respectively connect the clutch shafts 194 and 195 to two coaxially aligned drive shafts 202 and 203 and are constructed so that when each clutch shaft 194 and 195 is rotated in an anticlockwise direction, when viewed from above, this anticlockwise movement is transmitted to the coaxially aligned shaft 202 or 203 whereas, when each clutch shaft 194 and 195 is rotated in the clockwise direction, when viewed from above, the coaxially aligned drive shaft 202 or 203 is able to rotate freely in the opposite or anticlockwise direction.

Thus, if the rack member 186 is moved in a direction which causes anticlockwise rotation of pinion 198 and clutch shaft 194, as viewed from above, this motion is transmitted to drive shaft 202 through unidirectional clutch 200. A driving pinion 204 keyed to drive shaft 202 meshes with a driven pinion 205 which is connected to the shaft 169 by a right hand helical formations 206 so as to drive the second sun gear (not shown) in a clockwise direction, thus causing the drum 156 to continue its clockwise rotation. During this clockwise movement of the winch drum 156, the pinion 199 and clutch shaft 195 are driven in a clockwise direction by the toothed rack 186, but the drive shaft 203 is driven in an anticlockwise direction by means of a further driving pinion 207 which is keyed to the drive shaft 203 and meshes with the driving pinion 205. In this case, the oppositely directed rotations of the coaxially aligned shafts 203 and 195 are accommodated by the unidirectional clutch 201.

When the rack member 186 is moved in the opposite direction, so as to cause the pinion 199 and the clutch shaft 195 to rotate in an anticlockwise direction, as viewed from above, this movement is transmitted to the coaxially aligned drive shaft 203 and so the shaft 169 and the winch drum 156 continue to move in a clockwise direction. In this case, the anticlockwise movement of the drive shaft 202 and the clockwise rotation of the coaxially aligned shaft 194 are accommodated by the unidirectional clutch 200.

During pumping, when the second idler gear 166 connects the ring gear 162 to the second sun gear 165, the shaft 169 rotates in an anticlockwise direction and the right hand helical formation 206 lifts the driving pinion 205 out of engagement with the driving pinions 204 and 207, thus isolating the gear box 187.

I claim:

1. A winding arrangement for sheeting in a sail comprising:

(a) a winch drum;

(b) a piston-cylinder assembly having a double-acting piston, which is reciprocable within a cylinder;

(c) a manually operated pump means for supplying fluid under pressure to the piston-cylinder assembly;

(d) at least one rack member, having two toothed racks located on opposite outside edges thereof, coupled to the double-acting piston;

(e) means for directing the fluid under pressure supplied by the pump means alternately to opposite ends of the double-acting piston-cylinder assembly, thereby to reciprocate the piston, which effects reciprocating movement of the rack member;

(f) two unidirectional clutches, each having an input and an output shaft;

(g) a first gear means, meshing with one of the toothed racks of the rack member, coaxially mounted on the input shaft of each of the two unidirectional clutches;

(h) a second gear means mounted on the output shaft of each unidirectional clutch;

(i) a winch drum having a drive shaft mounted thereon; and (j) a driving pinion gear coaxially mounted on the winch drum drive shaft and meshing with both second gear means of the two unidirectional clutches; whereby the reciprocating movement of the rack member causes the rotation, in opposite directions, of both first gear means, which, in turn, rotate the input shafts of the two unidirectional clutches, causing the rotation of the output shaft of whichever clutch is engaged and the second gear means mounted thereon, causing the driving pinion gear to rotate, driving the winch drum through the winch drum drive shaft.

2. A winding arrangement as claimed in claim 1, wherein the means for supplying fluid alternately to opposite ends of the double-acting piston-cylinder assembly comprises a flow reversing valve operable in response to reciprocating movement of the rack member.

3. A winding arrangement as claimed in claim 2, wherein the flow reversing valve is operated by a trigger engageable by strikers actuated by reciprocating movement of the rack member.

4. A winding arrangement as claimed in claim 1, wherein the means for supplying fluid alternately to opposite ends of the double-acting piston-cylinder assembly includes a control valve which is manually operable and which is located at a position remote from the piston-cylinder assembly.

5. A winding arrangement as claimed in claim 4, wherein the means for supplying fluid alternately to opposite ends of the double-acting piston-cylinder assembly includes a pressure fluid vessel arranged to be charged by the manually operated pump and to supply fluid under pressure to the piston-cylinder assembly.

6. A winding arrangement as claimed in claim 5, including a further winding arrangement, a further piston-cylinder assembly connected to the pressurized fluid vessel by a supply line, and further control valve means provided in the supply line by which pressurized fluid is directed to either the first-mentioned piston-cylinder assembly or the further piston-cylinder assembly.

7. A winding arrangement as claimed in claim 1, wherein a rack member is coupled to each end of the double-acting piston, each rack member having a winch drum associated therewith and being arranged to produce unidirectional rotation of its associated winch drum when the double-acting piston is reciprocated.

8. A winding arrangement as claimed in claim 1, wherein there are two piston-cylinder assemblies, and a rack member is coupled to each end of each piston-cylinder assembly, each rack member being arranged to rotate a winch drum, and the two piston-cylinder assemblies being operable selectively.

* * * * *